US005126039A

United States Patent [19]

Silander

[11] Patent Number: 5,126,039

[45] Date of Patent: Jun. 30, 1992

[54] DEVICE FOR THE FRACTIONATION OF PULP

[75] Inventor: Risto Silander, Helsinki, Finland

[73] Assignee: Jaakko Ppyry Oy, Helsinki, Finland

[21] Appl. No.: 492,732

[22] Filed: Mar. 13, 1990

[30] Foreign Application Priority Data

Mar. 16, 1989 [FI] Finland ..... 891261

[51] Int. Cl.[5] ..... B07B 1/22; D21D 5/00

[52] U.S. Cl. ..... 209/270; 209/17; 209/393; 210/304; 210/488

[58] Field of Search ..... 209/270, 268, 303, 304, 209/305, 306, 273, 250, 392, 393, 380, 17, 285, 286; 210/488, 304, 306, 359

[56] References Cited

U.S. PATENT DOCUMENTS

| | | | |
|---|---|---|---|
| 1,185,794 | 6/1916 | Haug | 209/270 |
| 2,913,114 | 11/1959 | Plaven | 209/273 |
| 3,229,815 | 1/1966 | Mathewson | 209/250 |
| 3,511,374 | 5/1970 | Beal | 209/305 X |
| 4,130,478 | 12/1978 | Swallow | 209/380 X |
| 4,383,918 | 5/1983 | Chupka et al. | 209/306 X |
| 4,430,232 | 2/1984 | Doucet | 210/488 X |
| 4,551,242 | 11/1985 | Mróz et al. | 209/270 X |
| 4,941,970 | 7/1990 | Åhs | 209/270 |

FOREIGN PATENT DOCUMENTS

| | | | |
|---|---|---|---|
| 19011 | 1/1985 | Japan | 209/17 |
| 2728 | of 1865 | United Kingdom | 209/304 |
| 450534 | 7/1936 | United Kingdom | 209/273 |

*Primary Examiner*—Donald T. Hajec

*Attorney, Agent, or Firm*—Spensley Horn Jubas & Lubitz

[57] ABSTRACT

The invention relates to a device for the fractionation of pulp, having a chamber (1) which has a circular cross section and has in its upper section an inlet (2) for the pulp to be fractionated and in its lower section an outlet (3) for the first fraction. In addition, the chamber (1) has a screen which is rotatable about its vertical axis (7), has a circular horizontal cross section and is closed at its ends in relation to the chamber, the screen having on its circumference a plurality of apertures and inside it an outlet (4) for the second fraction. In order to prevent clogging, the circumferential wall of the screen (5) is made up of substantially parallel laminae (8, 9), secured one above the other at a distance from one another, the outer edges of the laminae (8) being oriented obliquely downward.

10 Claims, 1 Drawing Sheet

DEVICE FOR THE FRACTIONATION OF PULP

BACKGROUND OF THE INVENTION

The present invention relates to a device for the fractionation of pulp, and quite particularly to a device which has a chamber, preferably of a circular horizontal cross section and having in its upper section an inlet for the pulp to be fractionated and in its lower section an outlet for the first fraction. In addition, the chamber has a screen rotatable substantially about its vertical axis, having a substantially circular cross section and being at its ends closed in relation to the chamber. On the circumference of the screen there are numerous apertures and inside it an outlet for the second fraction.

So-called pressurized screens of the above type have previously been used for the fractionation of various solids in an aqueous suspension, and in particular for the separation of cellulose fibers from coarser fiber clusters. In these known pressurized screens, solids are graded according to the particle size. They have, fitted inside a cylindrical chamber, an also cylindrical screen basket rotating about its vertical axis, with round or oblong apertures on its circumference. In these pressurized screens, efforts have been made to affect the grading result and to keep the screen apertures clean by the selection of the size, shape and frequency of the apertures in the screen basket. Efforts have been made to avoid clogging of the apertures, for example, by means of blades moving along the screen basket or by making the cylindrical surface of the screen basket uneven in shape, for example, wave-like, in order to ensure its keeping clean.

In all prior-art systems the grading is based on affecting the grading result by regulating the size, shape or frequency of the apertures in the cylindrical wall of the screen basket, so that solid particles of different sizes or shapes, such as fibers and fiber clusters, are separated from each other into different fractions. These pressurized screens known per se have a disadvantage in the tendency of the holes or slits of the screen basket to become clogged.

SUMMARY OF THE INVENTION

The object of the present invention is therefore to provide for the fractionation of pulp a device in which the above-mentioned disadvantages have been eliminated. Contrary to the systems mentioned above, in which the separating is based on the grading of the solids according to the particle size, solids, and especially fibers, are separated into two fractions, namely a fine and lightweight fraction and respectively a coarse and heavy fraction, according to their specific weights. The pressurized screen according to the present invention also uses a rotating screen basket having slits in its circumferential wall, but these slits can be made so large in relation to the solid particles that there is no risk of clogging. In spite of this, particles of different sizes and of different specific weights can be separated reliably into separate fractions.

In the device according to the present invention, the circumferential wall of the screen is thus made up of substantially parallel laminae, one above the other and fixed at a distance from each other, the laminae or their outer edges being oriented obliquely downward. The present invention thus applies the laminar separation principle, known from other contexts, to the fractionation of pulp in a pressurized screen by replacing the apertures or slits previously used in the wall of the screen basket by so-called mini-laminae.

In the system according to the present invention the screen wall of the screen basket of the pressurized screen has thus been replaced with a miniature lamina structure, in which, by means of a centrifugal force generated by rotating the screen basket, the heavier fiber fraction is separated onto the obliquely downward oriented surfaces of the laminae, such as their outer edges, whereas, owing to the pressure difference, the lighter fraction passes between the laminae, flowing to the inside of the screen basket.

The laminar separation principle has previously been used, for example, in separators in the dairy industry and in laminar settlers of waste waters and oil-containing waters. In these, the heavier constituent is separated onto a surface which is at an angle to the direction of either gravity or centrifugal force, and this heavier constituent moves along it in the direction parallel to the force. The lighter constituent moves in the opposite direction on another, parallel, surface on the protected side of the vector of the force. In these prior-known systems, the distance of the parallel surfaces from each other is relatively great, and the length of the surfaces, i.e. the separation space, is also great. The above-mentioned laminar separation principle has now, in a modified form, been applied in the cellulose industry in pulp screens which are under hydraulic pressure and in which the pulp to be separated is brought into a vigorous rotational motion. In a manner deviating from previous pressurized screens, cellulose fibers and fiber clusters are now separated from each other on the basis of their specific weights, and thus the grade of the paper made from cellulose fibers can be improved considerably.

In the device according to the invention, the inclination of the outer edges of the laminae of the screen basket is preferably approximately 30°–50° from the horizontal plane. In a manner deviating from previously known laminar separators, in the device according to the invention the radial dimension, i.e. the width, of the laminae of the screen basket is relatively small, preferably approximately 2–10 times, for example 3–5 times, the distance between the laminae. Although the laminae are close to each other, they are, however, in relation to the fiber fractions to be graded, so far from each other that there is no risk of clogging.

The laminae are preferably ring-like, in which case they are stacked one above the other at a small distance from each other and linked to one another by means of vertical strips to form a cylindrical package of laminae. Although the outer edges of the laminae are inclined, their inner edges may be substantially horizontal. The radial width of the laminae is thus advantageously approximately 10–30 mm.

The upper end of the cylindrical laminar screen is preferably closed with a cover, whereas its lower end is against the bottom of the chamber. In this case the lower end of the screen may be open, there being preferably in the bottom of the chamber a central aperture for removing one fraction from inside the screen through the bottom of the chamber.

The pulp inlet can be connected to the upper section of the chamber tangentially and in parallel to the rotational direction of the screen, in order to produce as effective an eddy as possible inside the chamber.

The outlet for the first fraction is preferably on that side of the screen which is opposite to the pulp inlet, in the lower section of the chamber wall to prevent the pulp from flowing directly from the inlet to the above-mentioned outlet.

DETAILED DESCRIPTION OF THE PREFERRED EMBODIMENT

The invention is described below in greater detail with reference to the accompanying drawings.

Figure 1:
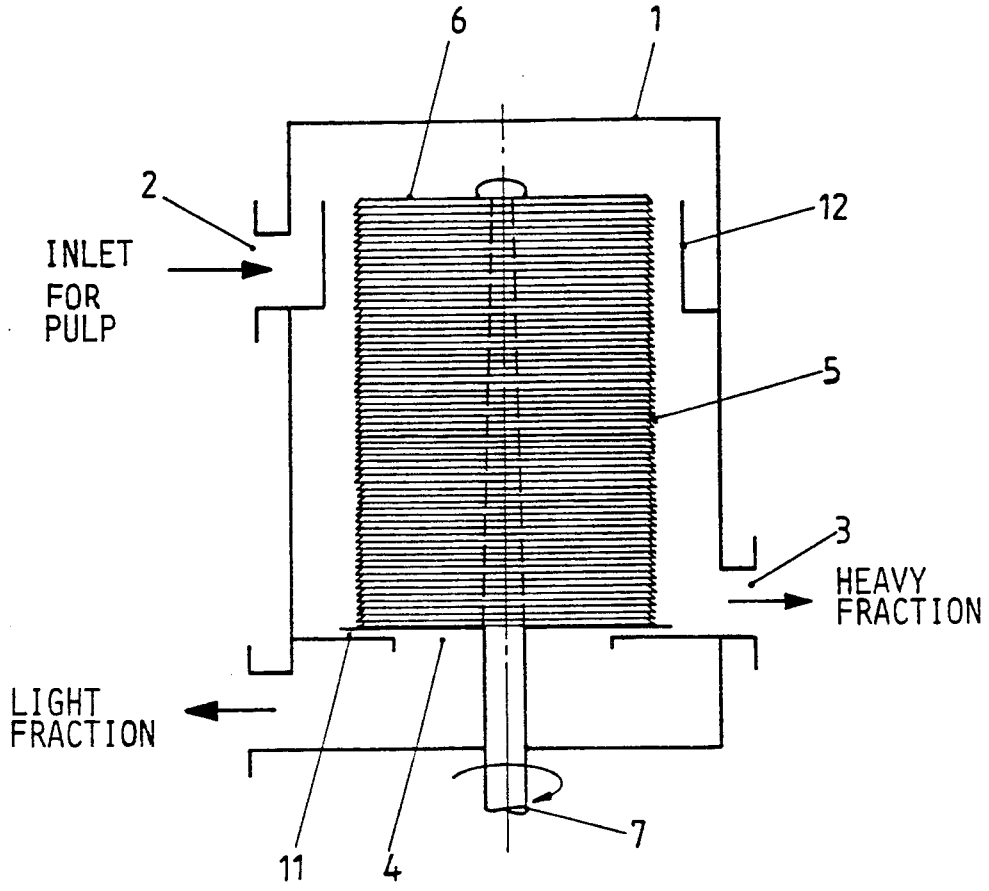
FIG. 1 is a schematic side elevation view, in cross section, of a pulp fractionation apparatus in accordance with the present invention.

In FIG. 1, the closed chamber of the pressurized screen, having the shape of an upright cylinder, is indicated by reference numeral 1. The pulp to be graded is introduced into the upper section of the chamber 1, via an inlet 2 meeting it tangentially, in order to bring the pulp into a rotational motion inside the chamber 1. In the lower section of the wall of the cylinder 1 there is additionally an outlet 3 for the heavier fraction, on the side opposite in relation to the pulp inlet 2 in the upper section of the chamber 1. The chamber 1 additionally has an upper wall 12 and a bottom 11. The bottom 11 has additionally a central aperture 4, through which the lighter fraction is removed from the pressurized screen according to the invention. The upper wall 12 directs the pulp flow evenly onto the surface of the screen basket.

In the chamber 1 there is additionally installed centrally a screen 5, also having the shape of an upright cylinder and being rotatable about a vertical axis 7, the upper end of the screen being closed with a plate 6, but its lower end being open and fitted tightly against the bottom 11 of the chamber 1 on top of the above-mentioned outlet 4 for the lighter fraction.

Figure 2:
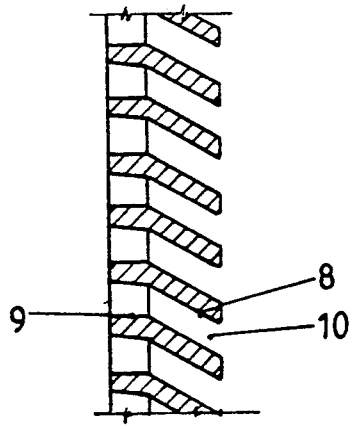
FIG. 2 is an enlarged schematic partial representation. in cross section, of a laminar screen wall of the fractionation apparatus shown in FIG. 1.

As can be seen in greater detail in FIG. 2, the circumferential wall of the screen 5 is made up of numerous laminae 8, 9, one above the other. The laminae are circular and extend conically downward at their outer circumference in order to form downwardly inclined surfaces 8 in the spaces 10 between the laminae, whereas the inner edges 9 of the laminae are substantially horizontal, but can also be made inclined, depending on the method of manufacture. The laminae are interconnected by means of a plurality of vertical strips 13 in order to form the lamina package depicted in FIG. 1. The screen 5 may also be turned from one piece.

By rotating the screen 5 about its axis 7, the rotational motion of the pulp in the chamber 1, and thereby the centrifugal force, is enhanced. Between the pulp inlet 2 and the finer fraction outlet 4 there is maintained a pressure difference of such magnitude that the finer fraction will flow through the slits 10 between the laminae to inside the screen 5, against the centrifugal force, and the pressure difference and the rotational velocity are regulated so that the heavier fraction will separate in the spaces 10 between the laminae and move, under the centrifugal force, against the downwardly inclined surfaces 8 of the laminae, sliding along them under the effects of centrifugal force and gravity, back to outside the screen 5, descending to the bottom of the chamber 1, and leaving through the outlet 3. For the fractionation of pulp it is thus possible to use a screen 5 having, for example, a height of 80 cm and a diameter of 60 cm, when it has approximately 80 lamina rings, their total grading surface area being approximately 1.5 $m^2$. By means of a device such as this it is possible in an effective and simple manner to separate individual fibers from fibers having a greater specific gravity.

I claim:

1. A device for the fractionation of pulp comprising:

a substantially cylindrical chamber having an inlet at an upper portion thereof for feeding an aqueous suspension containing pulp to be fractionated and a first outlet at a lower section thereof for outfeeding a first fraction;

a substantially cylindrical screen member provided within said chamber, said screen member being rotatable about an axis of rotation and having a circumferential wall about said axis of rotation, a plurality of apertures in said circumferential wall for screening the aqueous suspension, and a lower end defining a central aperture for discharging a second fraction finer than said first fraction;

wherein said circumferential wall of said screen member comprises a plurality of substantially parallel laminae spaced at a distance from one another, each of said laminae having an outer circumferential portion which includes a downwardly inclined lower surface against which said first fraction slidingly move under the effects of centrifugal force generated by the rotation of said screen member.

2. A device according to claim 1 wherein said inclined lower surface is angled at 30°–50° from the horizontal plane.

3. A device according to claim 1 wherein said laminae are ring-shaped and each has a radial width of approximately 2–10 times said distance between said laminae.

4. A device according to claim 3 wherein the radial width of said laminae is approximately 10–30 mm.

5. A device according to claim 1 wherein said chamber further comprises a bottom wall defining a second outlet therein and said central aperture of said screen member couples to said second outlet of said bottom wall of said chamber.

6. A device according to claim 1 wherein said inlet meet the upper portion of said chamber tangentially and in the direction of the rotation of said screen member.

7. A device according to claim 3 wherein said radical width is 3–5 times said distance between said laminae.

8. A screening apparatus for separating solids suspended in fluids comprising:

a chamber having a generally cylindrical internal wall, an upper end and a lower end;

inlet means provided in proximity to said upper end for feeding a suspension into said chamber in a direction substantially tangential to said internal wall;

first outlet means provided in proximity to said lower end for discharging the suspension containing first solids from said chamber;

a generally cylindrical rotatable screening member provided within said chamber for separating the suspension containing second solids finer than the first solids, said screening member having a plurality of substantially equally spaced circular laminae, each of said laminae having a downwardly inclined lower surface adapted to separate said first solids by the force of gravity and a centrifugal force generated by the rotation of said screening member; and second outlet means provided in proximity to said lower end of said chamber and coupled to the interior of said screening member for discharging the suspension containing the second solids from said chamber.

9. The screening apparatus according to claim 8 wherein said laminae are ring-shaped, each of said ring-shaped laminae having an outer circumferential portion oriented obliquely downward defining said downwardly inclined lower surface, and a plurality of cylindrical spacer members, each of said spacer members positioned between the adjacent laminae thereby positioning said laminae substantially in parallel with each other.

10. A screening apparatus for separating heavy solid particles from light solid particles contained in a suspension comprising:

a chamber having a generally cylindrical internal wall, a closed upper and a lower end;

inlet means provided in proximity to said upper end, said inlet means being adapted for feeding the suspension into said chamber and directing said suspension substantially tangentially to said internal wall to bring the suspension into a rotational motion along said internal wall;

first outlet means provided in proximity to said lower end of said chamber and on the opposite side with respect to said inlet means for discharging the suspension containing heavy solid particles;

a generally cylindrical screening member substantially concentrically provided within said chamber and rotatable about an axis of rotation, said screening member comprising a plurality of ring shaped laminae and a plurality of cylindrical spacer members, each of said spacer members positioned between the adjacent laminae thereby positioning said laminae substantially in parallel with each other, said spacer member including a plurality of apertures adapted for urging the suspension containing light solid particles into the interior of said screening member, each of said laminae having an outer circumferential portion including a downwardly inclined lower surface wherein the heavy solid particles between said ring-shaped laminae are moved outwardly against said lower surface by centrifugal force generated by the rotation of said screening member, said screening member further including a bottom end defining a central opening for discharging the suspension containing light solid particles;

flow guide means provided in proximity to said upper end of said chamber for directing the flow of the suspension evenly onto the external surface of said screening member; and second outlet means provided in proximity to said lower end of said chamber and coupled to said central opening of said screening member for discharging the suspension containing the light solid particles.

* * * * *